United States Patent [19]

Steeger

[11] Patent Number: 5,012,520

[45] Date of Patent: Apr. 30, 1991

[54] HEARING AID WITH WIRELESS REMOTE CONTROL

[75] Inventor: Gerhard Steeger, Erlangen, Fed. Rep. of Germany

[73] Assignee: Siemens Aktiengesellschaft, Berlin and Munich, Fed. Rep. of Germany

[21] Appl. No.: 342,870

[22] Filed: Apr. 25, 1989

[30] Foreign Application Priority Data

May 6, 1988 [DE] Fed. Rep. of Germany ..... 3815598

[51] Int. Cl.[5] ..... H04R 25/00

[52] U.S. Cl. ..... 381/68; 381/68.6; 600/25

[58] Field of Search ..... 381/68, 68.1, 68.2, 381/68.3, 68.4, 68.5, 68.6, 68.7, 69, 69.1, 69.2, 79, 105; 600/25

[56] References Cited

U.S. PATENT DOCUMENTS

| | | | |
|---|---|---|---|
| 3,712,962 | 1/1973 | Epley . | |
| 3,764,748 | 10/1973 | Branch et al. | 600/25 |
| 4,606,329 | 9/1986 | Hough | 600/25 |
| 4,612,915 | 11/1986 | Hough et al. | 381/68.3 |
| 4,689,820 | 8/1987 | Köpke et al. | 381/68 |
| 4,811,402 | 3/1989 | Ward | 381/68.6 |
| 4,855,746 | 8/1989 | Stacy | 358/194.1 |
| 4,913,157 | 4/1990 | Pratt, Jr. et al. | 128/661.03 |

FOREIGN PATENT DOCUMENTS

| | | | |
|---|---|---|---|
| 0176116 | 4/1986 | European Pat. Off. | 381/68 |
| 0242038 | 10/1987 | European Pat. Off. | 381/68.3 |
| 1938381 | 2/1971 | Fed. Rep. of Germany . | |
| 2407726 | 8/1975 | Fed. Rep. of Germany . | |
| 3431584 | 3/1986 | Fed. Rep. of Germany | 381/68 |

*Primary Examiner*—Jin F. Ng
*Assistant Examiner*—Jason Chan
*Attorney, Agent, or Firm*—Hill, Van Santen, Steadman & Simpson

[57] ABSTRACT

A control device for a hearing aid is inconspicuously held by a hearing aid user, such as in the palm of the hand, and includes a vibrator which emits a remote control signal at a frequency outside of the audible range of human hearing, and the hearing aid worn in the ear of the user has circuitry responsive to these remote control signals. The remote control signals are transmitted via the skeleton of the hearing aid user by transcutaneous coupling of a contact surface of the control device. The hearing aid includes a transducer for converting the received remote control signals transmitted via the body of the wearer into electrical signals for controlling at least some of the components of the hearing aid. The remote control signal may be coded, in which case the hearing aid will also include a recognition circuit for decoding the received signal.

15 Claims, 4 Drawing Sheets

HEARING AID WITH WIRELESS REMOTE CONTROL

BACKGROUND OF THE INVENTION

1. Field of the Invention

The present invention is directed to a hearing aid system, and in particular to such a system having a wireless remote control of at least some of the components of the hearing aid worn in the ear of a user.

2. Description of the Prior Art

A hearing aid having an in-the-ear unit and a control unit remote therefrom, with the control unit wirelessly transmitting control signals to the in-the-ear unit, is described in German OS 19 38 381. As is known, hearing aids should be as small as possible in order to permit the hearing aid to worn inconspicuously. Miniature hearing aids worn in the auditory canal are known. In this type of hearing aid, at least the volume, but also a number of other functions critical to adapting the hearing aid to different hearing situations, should be variable as much as possible. It is necessary that adjustment devices be provided which are accessible by the user while the hearing aid is functioning in contact with the user. Moreover, the range of manipulation during adjustment should be discernable.

The hearing aid described in German OS 19 38 381 has components divided into two housings, one housing containing a transmitter and the other housing containing the hearing aid which is worn in the ear. Signals are wirelessly transmitted from the transmitter to the in-the-ear unit, which includes a receiver tuned to the transmitter. The housing for the in-the-ear hearing aid, however, provides very little extra space for the receiver. Typical in-the-ear hearing aids worn in the auditory canal generally have less than 100 cubic mm available for the incorporation of a remote control receiver. In German OS 19 38 381, therefore, a receiver was provided which operates without the need for an additional sensor, an antenna or the like.

Another hearing aid is described in German OS 34 31 584, having a remote control unit wherein the microphone of the hearing aid is used both as a receiver for the control signals and as a conventional microphone. Inaudible sound, such as ultrasound, is used for the transmission of the control signals. The ultrasound transmitter is disposed in a control device, and control signals are generated via a keyboard and are generated as an output by a speaker. In the in-the-ear portion of the this hearing aid system, the signals received by the microphone are deployed to two branches, one branch leading to the sound generating portion of the hearing aid, and the other branch leading to a control portion of the hearing aid via a filter which blocks all signals except the ultrasound signals.

The hearing aid described in German OS 34 31 584 is substantially free of switches and other control-associated components by virtue of the use of remote control. The following functions occur in sequence in the remote operation. After the actuation of an operating key, the transmitter electronics identifies this event, and encodes a control signal in accordance with the desired function, and this encoded control signal is then transmitted. The inverse operational sequence occurs in the receiver. The signal is received, decoded, and identified, and the corresponding electronic adjustment element is actuated. Other types of signal transmission, such as electromagnetic transmission and infrared transmission are described in German OS 24 07 726 for the remote transmission of hearing aid control signals, as well as the aforementioned ultrasound transmission.

Each of the above-described types of signal transmission have a transmission path associated therewith which can be undesirably influenced by specific sources of disturbance. For electromagnetic transmission, for example, a large number of electromagnetic sources of disturbance may contribute to degrading the transmission path, and thus must be taken into consideration. Moreover, the availability of transmission frequencies is very limited due to regulations in various nations, and differs greatly from country to country. Infrared transmission can be disturbed by direct solar irradiation on the receiver diode, which must of necessity be located at a exposed location at the hearing aid.

The ultrasound transmission path can be disturbed by radio frequency sound sources such as, for example, an ultrasound cleaning bath.

Moreover, additional component parts are required for reception of the control signals using electromagnetic transmission or infrared transmission, whereas the microphone, which is already present in the hearing aid, can be used for ultrasound transmission. It has been shown, however, that as a result of known, special propagation conditions of ultrasound, the main emission direction of the speaker in the remote control transmitter must be directed rather precisely in the direction of the opening of the auditory canal, in order to be able to drive the in-the-ear hearing aid. To this end, the transmitter must be lifted relatively high, or must be held relatively far from the body. Aiming is relatively difficult for persons having little capability to perceive things in three dimensions, because this aiming must be undertaken without direct visual control. Moreover, many patients find such a manipulation undesirable, because it may direct the attention of persons with whom they are speaking to their hearing impediment. These problems can be magnified if the hearing aid is seated more deeply in the auditory canal. This is a particular problem with smaller auditory canal hearing aids, but can also arise in implanted hearing aids as described in German OS 36 17 118.

SUMMARY OF THE INVENTION

It is an object of the present invention to provide a hearing aid system having an in-the-ear or implanted unit for magnetic or mechanical excitation of the middle ear and a wireless remote control unit for supplying control signals to the in-the-ear or implanted unit.

It is a further object of the present invention to provide such a hearing aid system wherein transmission of the control signals from the control unit to the in-the-ear or implanted unit is reliable and relatively disturbance-free.

Another object of the present invention is to provide such a hearing aid system wherein the remote control unit can be held and used inconspicuously.

The above object is achieved in a hearing aid system wherein the remote control unit includes a vibrator functioning as the transmitter of control signals for the control unit, the vibrator generating a signal at a control frequency outside the audible range of human hearing, and the remote control unit being adapted so that the control signals can be transmitted via the skeleton of the person wearing the in-the-ear (or implanted) unit by a transcutaneous coupling with a contact surface of the control device. The in-the-ear (or implanted) unit includes a sound transducer which converts the skeletal transmitted sound signals from the control device into electrical signals. The transducer is connected to certain components in the in-the-ear (or implanted) unit for supplying control signals thereto. Those controlled components may be, for example, an electronic potentiometer for volume adjustment, sound diaphragms, a changeover switch for switching between the hearing aid coil or a microphone, an on/off switch for noise suppression circuits, and the like. Additionally, if the control signal which is transmitted is encoded, the in-the-ear (or implanted) unit will include a decoding and recognition unit.

The invention uses sound signals which are outside of the human audible hearing range as the carrier for the remote control signals, with the transmission medium being the skeleton of the hearing aid user, particularly the skull bones of the user. The remote control signals are thus body or bone borne, as opposed to transmission via the outer ear by conventional airborne transmission, as in known systems. The remote control transmitter can be held relatively inconspicuously in an embodiment wherein the user of the hearing aid holds the small control device in the palm of his or her hand, and excituates movements for making transcutaneous contact of a surface of the control device with his or her bone structure. Such hand movements may be interpreted by persons participating in a conversation with hearing aid user as if the hearing aid user were adjusting his or her glasses, running fingers through his or her hair, resting his or her head, or the like.

The hearing aid system disclosed herein operates using sound waves, particularly in the ultrasound range but also in the low-frequency range outside of the audible range of human hearing. These signals are generated as an output by the vibrator of the remote control unit such that when the control unit is placed, for example, on the skin of the user's head, the signals cause the skull bones to oscillate. via the petrous part of the temporal bone. These vibrations are transmitted to the unit of the hearing aid system worn in the auditory canal, which includes a sound transducer for converting those signals into electrical signals. Decoding of the incoming signal yields a control signal for setting various hearing aid functions.

DESCRIPTION OF THE PREFERRED EMBODIMENTS

Figure 1:
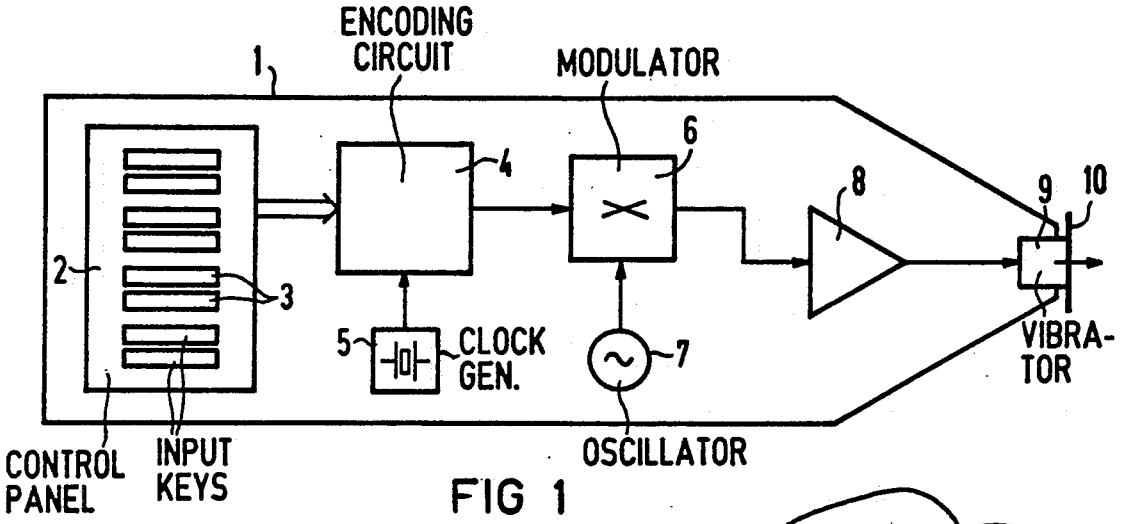
FIG. 1 is a block diagram of a wireless control unit for a hearing aid system constructed in accordance with the principles of the present invention.
Figure 2:
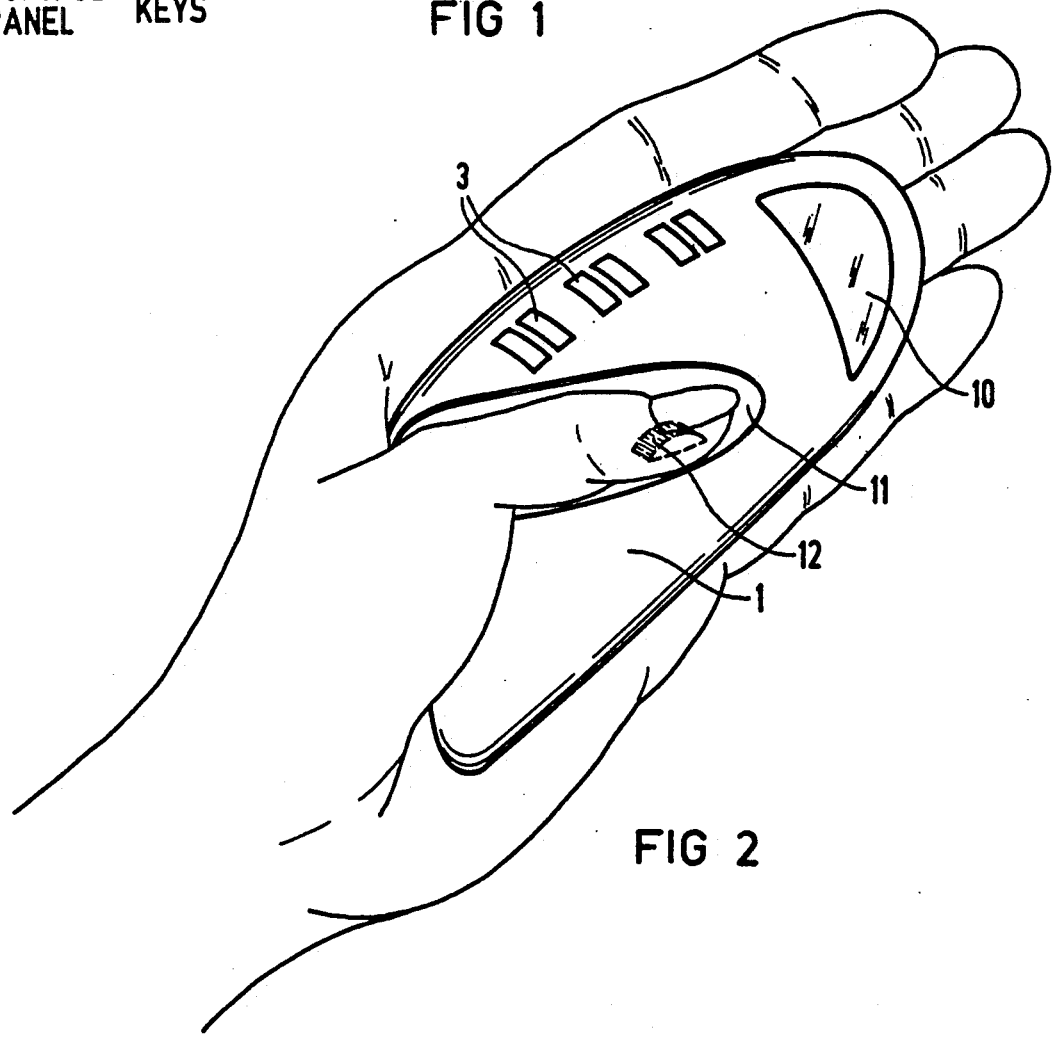
FIG. 2 shows a control device of the type shown in FIG. 1 held in the hand of a hearing aid user.
Figure 3:
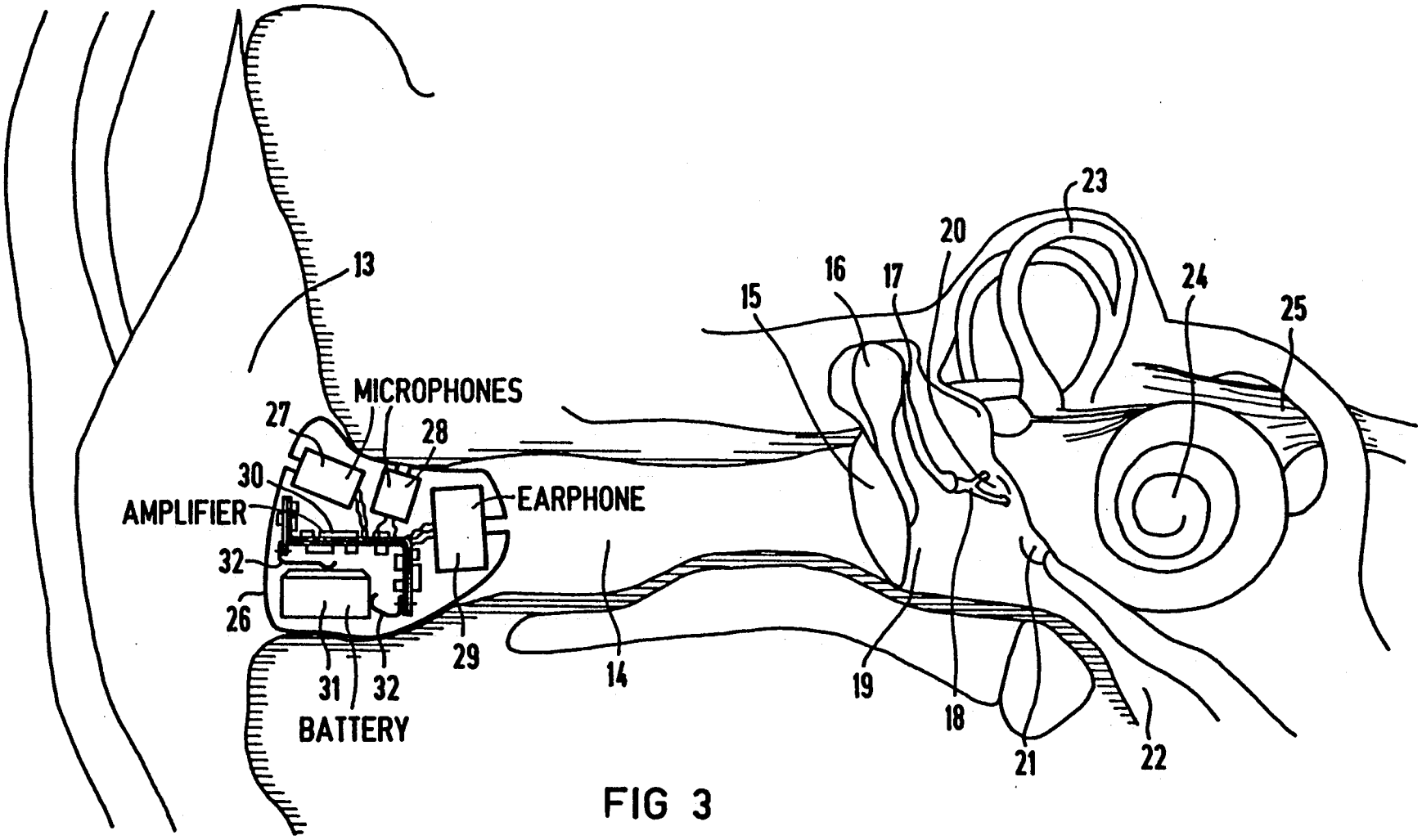
FIG. 3 is a side sectional view of the in-the-ear unit of a hearing aid system constructed in accordance with the principles of the, present invention also showing the relevant anatomy of the middle and inner ear.
Figure 4:
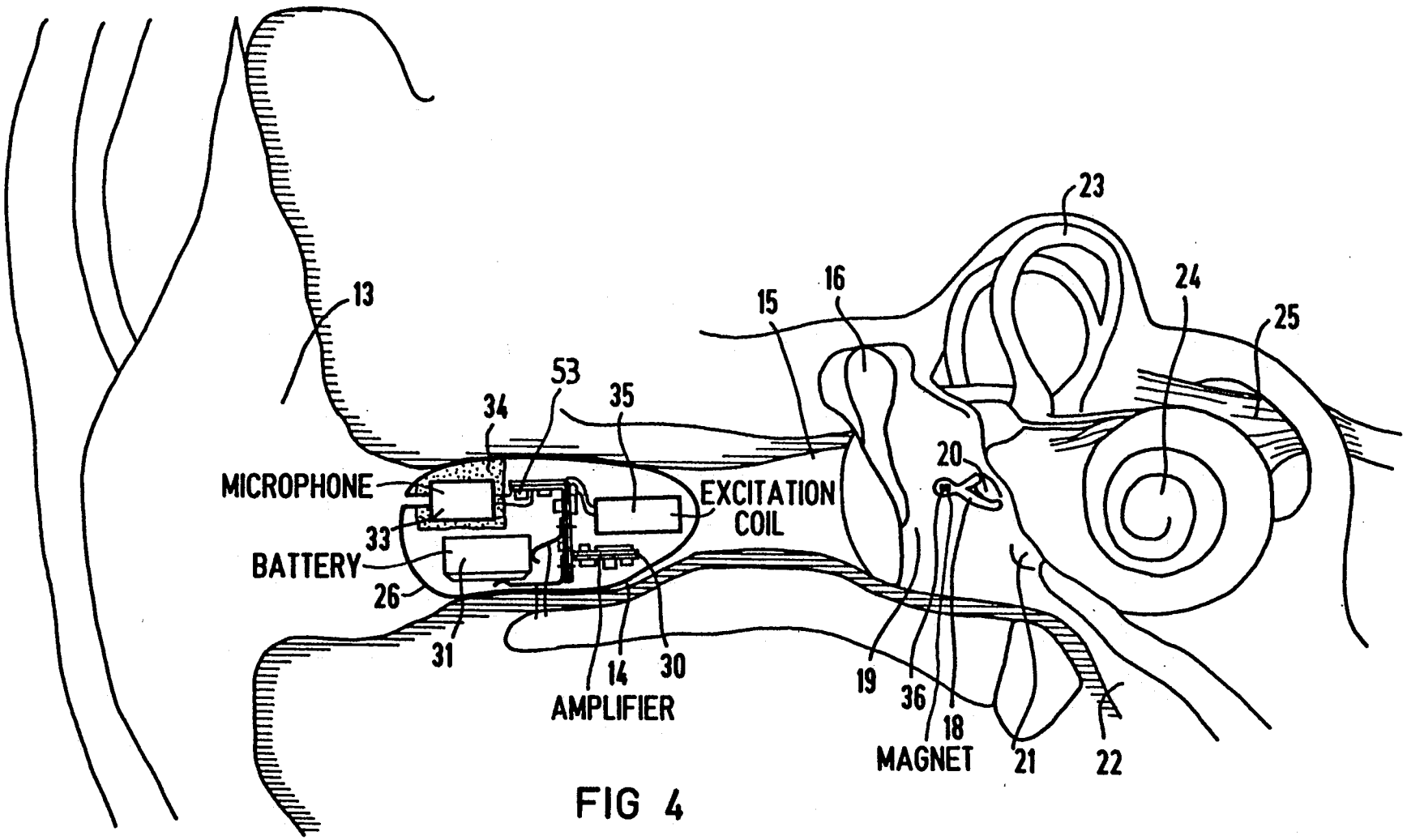
FIG. 4 is a side sectional view of a further embodiment of the in-the-ear unit of a hearing aid system constructed in accordance with the principles of the present invention also showing the relevant anatomy of the middle and inner ear.
Figure 5:
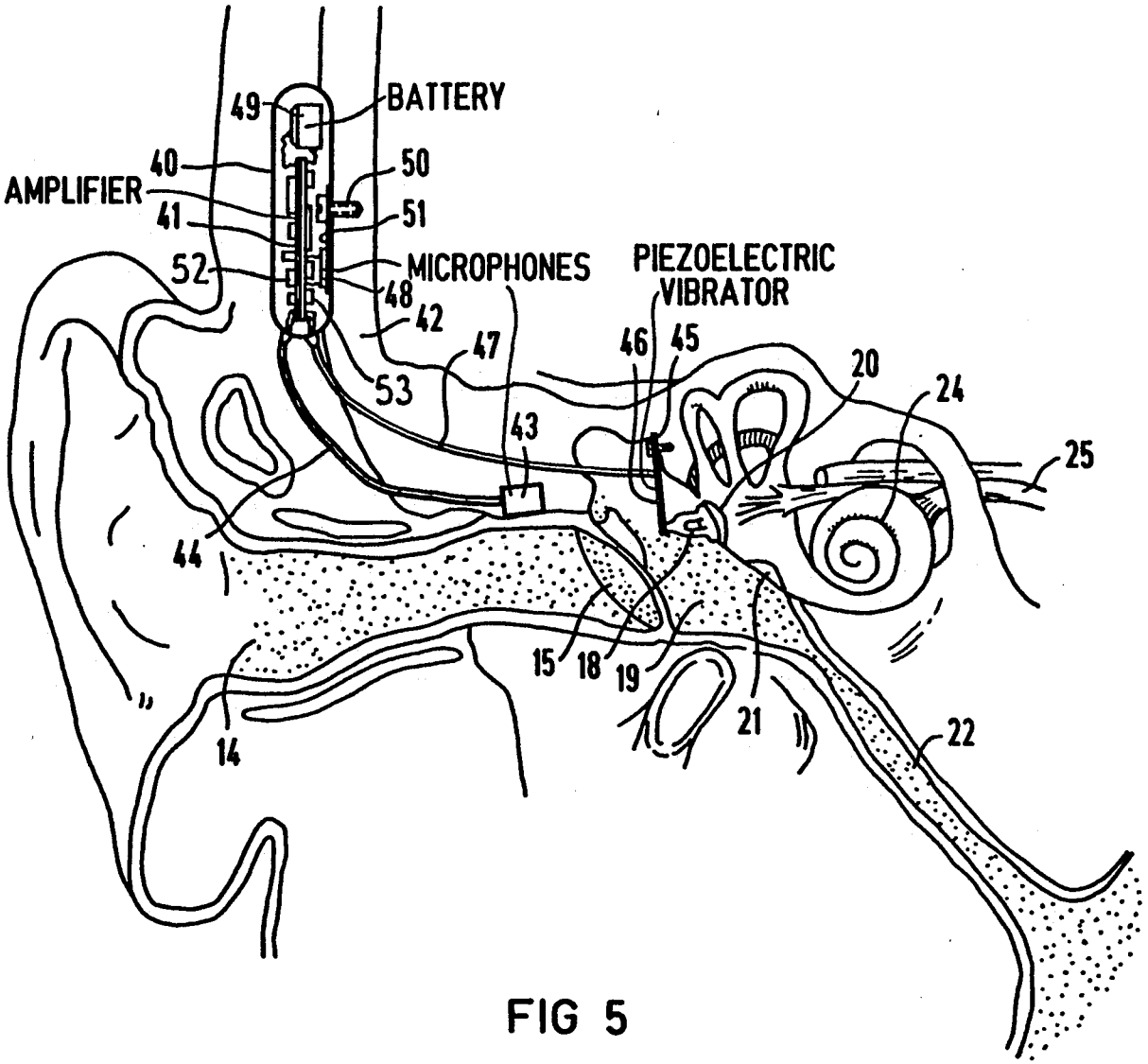
FIG. 5 is a sectional view of the implanted components of a hearing aid constructed in accordance with the principles of the present invention as well as the relevant anatomy of the middle and inner ear.

A control unit 1 is shown in FIGS. 1 and 2 for use in a hearing system with one of the in-the-ear or implanted units shown in FIGS. 3 through 5. The control unit 1 is a handy, small, battery operated unit having a housing which can be favorable ergonomically designed. For example, the control unit may include a control panel 2 having a number of sensor keys 3 for triggering various functional changes to be achieved by remote control at the hearing aid unit. (As used herein, "hearing aid unit" and "hearing aid means" encompass an in-the-ear unit as shown in FIGS. 3 and 4, as well as an implantable unit as shown in FIG. 5.) For example, the control signals may set the volume, turn the hearing aid unit off and on, operate one or more filter circuits, turn a circuit for automatic noise suppression on or off, switch the hearing aid means from a microphone mode to a telephone coil mode, etc. The control device includes an encoding circuit 4 which generates a serial sequence of data and check bits in accordance with a programming or control instruction entered by touching the sensor keys 3. The encoding circuit 4 constantly repeats the sequence with a transmission clock frequency defined by the frequency of a clock generator 5. These sequences are transmitted to a modulator 6 until a timing circuit, also fed by the clock generator 5, concludes the transmission and switches the control device back to its readiness of standby condition. The modulator 6 modulates a carrier signal generated by an oscillator 7 with the serial information received from the encoding circuit 4. The signal generated by the oscillator 7 may already have a carrier frequency in a range inaudible for human hearing, or at least not disturbing when acoustically transmitted via the skeleton of the user, or the modulator 6 may shift the modulated signal to a carrier frequency in that range. In any case, audible, airborne sound transmission does not take place. The modulator 6 is followed by a final amplifier 8, which boosts the output signal to a power level which suffices for reprogramming the hearing aid means. The output of the amplifier 8 is supplied to a vibrator 9 having a contact surface 10 which serves to transcutaneously couple the programming or control signal emanating from the vibrator 9 to the bony skeleton of the user of the hearing aid system.

Selection of the operating function with the sensor keys 3 can be undertaken before the control device 1 is applied to the skin, so that the remote control can be undertaken as inconspicuously as possible. During actual application to the body surface, actuation of the sensor keys 3 is still possible, but is not necessary. In one embodiment, the transmitter may operate for a fixed time, for example 5 seconds following the removal of the finger from the activated sensor key or keys, and then discontinues transmission.

In a further embodiment, the control unit 1 remains activated as long as the contact surface 10 of the vibrator 9 is pressed against the skin. In this embodiment, turning the control unit 1 on and off can be effected by sensor strips on the contact surface 10, or by a moveable seating of the vibrator 9 in combination with a mircoswitch. This form of executive control also minimizes energy consumption of the control device.

FIG. 2 shows an embodiment of a housing design for the control device 1 in the form of a flat unit adapted to the shape of the palm of the hand, and coated in anti-slip fashion at its back side (facing toward the hand). In this embodiment, the control device 1 can be inconspicuously moved, for example, to the head of a user hidden in the slightly curved hand. A gripping depression 11 in the housing promotes retention and actuation of the control device 1 with one hand. For example, a switch shown at the control device 1 under the thumb in FIG. 2 may be actuateable by a wheel 12 for adjusting a particular function already selected via the sensor keys 3. Rotation of the wheel 12 may intensify the function (for example, the volume) given movement in the direction of the tip of the thumb, and diminishes the function given movement in the direction of the base of the thumb. When released, the switch or actuation wheel preferably assumes a neutral middle position. If the switch 12 is not needed for a simple switching function (for example, microphone off, hearing aid coil on for telephone operation), it remains non-functioning.

FIGS. 3 shows the outer ear 13 including the auditory canal 14, the middle ear including the tympanic membrane 15, the malleus 16, the incus 17, the stapes 18, the tympanic cavity 19, the oval window 20, the round window 21, and the eustachian tube 22, and the inner ear including the semi-circular canals 23, the cochlea 24 and the auditory nerve 25. An in-the-ear hearing aid is inserted in the auditory canal 14, having a housing shell 26 adapted in shape to the auditory canal, and including a microphone 27 for transforming voice sounds into electrical signals. The microphone 27 is decoupled from the housing 26 with respect to body or bone borne sounds so that the remote control signals from the transmitter do not interfere with the voice sound signals within the microphone 27. A second sound transducer 28 is provided in and coupled to the housing shell 26 so that the transducer 28 is sensitive to (i.e., receives) the body or bone borne sound signals from the remote control unit 1. These signals are then used to control and program the in-the-ear hearing aid by conversion of the received signals into electrical control instructions. The ear phone 29 of the in-the-ear hearing aid picks up the electrical signals from the microphone 27, which are amplified in an amplifier 30 and reshaped (for example, filtered and/or reduced in dynamics). The ear phone 29 generates the sound oscillations as an output in the direction of the tympanic membrane 15. Contact springs 32 are provided for electrical contact between a battery 31 and the amplifier 30. The sound transducer 28 integrated in the in-the-ear unit may be a microphone specifically designed for the proper transmission frequencies and mechanically well coupled to the housing shell 26 of the in-the-ear unit. As noted above, the transducer 28 is electrically and mechanically separated from the conventional microphone 27 used to receive the voice signals.

In the embodiment of FIG. 4, the sound transducer used for the voice signals is simultaneously used as the sound transducer for the body or bone borne remote control sound signals. In the embodiment of FIG. 4, the microphone 33 which serves both of these functions supplies a signal to a frequency selective circuit 53 which separates the remote control signals from the voice signals. The frequency-selective circuit may be of any type well known to those skilled in the art, for example, a circuit having high-pass and low-pass filters. In a preferred embodiment, the sound transducer 33 is mounted in a plastic pocket 34 having a high attenuation in the audible range, but having a low attenuation in the range of the carrier frequency of the remote control signals. As shown in FIG. 4, the sound transducer 33 is supported against an interior wall of the housing shell 26 by the plastic pocket 34, with the transducer 33 being embedded therein. The plastic pocket 34 may consist, for example, of expanded plastic.

In the Embodiment of FIG. 4, a magnetically excitable implanted component is disposed in the middle ear, in the form of permanent magnet 36. The housing shell 26 can be freely removed from the auditory canal 14. An excitation coil 35 is contained in the housing shell, and is connected to the amplifier 30 for excitation of the permanent magnet 36 secured to the stapes 18. The permanent magnet 36 may be secured to the stapes 18, for example, by a screw connection or by suitable adhesive. The excitation coil 35 is supplied with the amplified electrical output signal from the amplifier 30, and this signal is transmitted to the small permanent magnet 36 secured to the stapes 18, the transmission being in the form of an alternating magnetic field. The permanent magnet 36 is thus placed in oscillation, and transmits the voice sound signals to the inner ear. To attach the permanent magnet 36, the middle ear is opened, and the incus is removed.

A fully implantable hearing aid means is shown in FIG. 5, including a liquid-tight and gas-tight housing 40 consisting of tissue-compatible material. An amplifier 41 is contained in the housing 40, and is secured with a screw 50 or other suitable connection to the skull bone 42, not only for the purpose of fixing or mounting, but also for the transmission of body and bone borne sound. A microphone 43 is implanted in the region of the auditory canal 14. The microphone 43 picks up voice sound signals conducted through the auditory canal, and supplied those signals via an electrical line 44 to the input of the amplifier 41 in the form of electrical signals. A piezoelectric vibrator 45 is secured to the skull bone such that the vibrator 45 has a free end 46 which places the stapes 18 in vibration as soon as the vibrator deforms under the influence of the electrical alternating voltage transmitted from the output of the amplifier 41 via an electrical line 47. The incus and malleus are removed for the implantation of the vibrator 45. A circuit board having integrated and discrete components for the amplifier 41 is provided, as well as a battery 49. If the implantable hearing aid means has a mechanical vibrator 45 for excitation of the stapes 18, the amplifier 41 including the battery 49 can also be implanted, because of the low power consumption. An efficient coupling of the remote control signals is possible by virtue of the mechanical contact between the amplifier 41 and the skull bone 42 achieved by the screw 50, and a connecting web 51. The housing 40 also contains a decoding circuit 52 which decodes the incoming encoded signals.

If the amplifier 41 is not to be fully implanted, or if mechanical coupling via the screw 50 is not possible for other reasons, the attachment of the vibrator 45 (close to the stapes 18) can serve as a contact location for the body or bone borne sound transmission, with the body or bone borne sound vibrations being supplied to the amplifier 41 can be supplied mechanically via a stiff wire, connecting web or the like disposed between the securing means for the vibrator 45 and the microphone 48. Coupling may also be undertaken electrically by attaching a microphone such as the microphone 48 at the same location as the vibrator 45.

Although modifications and changes may be suggested by those skilled in the art it is the intention of the inventor to embody within the patent warrant hereon all changes and modifications as reasonably and properly come within the scope of his contribution to the art.

I claim as my invention:

1. A hearing aid system comprising:

hearing aid means adapted to be disposed in the region of the ear of user for assisting the user in recognition of sound having frequencies in the normal human audible sound range, said hearing aid means including at least one adjustable component;

wireless control means adapted to be held in the hand of said user for generating an information-containing signal corresponding to information entered by said user for adjusting said adjustable component of said hearing aid means;

a vibrator in said wireless control means for generating an acoustic control signal including said information containing signal, said vibrator vibrating at a frequency outside of said normal human audible sound range having a contact surface adapted for contact with the skin of the user to acoustically transmit said acoustic control signal via the body of said user; and receiver means included in said hearing aid means for receiving said acoustic control signal after transmission through the body of said user and for converting said acoustic control signal into an electrical control signal for adjusting said adjustable component.

2. A hearing aid system as claimed in claim 1, wherein said hearing aid means comprises:

a housing shell adapted for insertion in the auditory canal of said user;

a microphone disposed in said shell sensitive to said sound having frequencies in the normal human sound range and to said frequency outside of said normal human audible sound range so that said microphone functions both to pick-up sound in the normal human audible sound range and as said receiver means, said microphone having an output;

mounting means for seating said microphone in said shell consisting of plastic which attenuates acoustic coupling in said normal human audible sound range and is acoustically transmissive at said frequency outside of said normal human acoustic sound range; and frequency-selective means connected to said output of said microphone for separating signals corresponding to sound having frequencies in the normal human audible sound range from said acoustic control signal at said frequency outside of said normal human audible sound range.

3. A hearing aid system as claimed in claim 2, wherein said shell has an inner wall and wherein said mounting means is disposed in contact with a portion of said inner wall.

4. A hearing aid system as claimed in claim 1, wherein said hearing aid means comprises:

means for converting said sound having frequencies in the normal human audible sound range into electrical signals;

coil means supplied with said electrical signals for generating an alternating magnetic field corresponding to said electrical signals; and a permanent magnetic adapted to be secured to the stapes in the ear of said user and disposed in said alternating magnetic field so that said permanent magnetic and said stapes are placed in motion corresponding to said sound having frequencies in the normal human audible sound range.

5. A hearing aid system as claimed in claim 1, further comprising:

a housing shell for said hearing aid means adapted to be introduced in the auditory canal of said user;

first sound transducer means disposed in said housing shell for converting said sound having frequencies in the normal human audible sound range into electrical signals;

means for acoustically decoupling said first sound transducer means from said housing shell;

second sound transducer means disposed in said housing shell and tuned to said frequency outside of said normal human audible sound range functioning as said receiver means; and means for acoustically coupling said second sound transducer means to said housing shell.

6. A hearing aid system as claimed in claim 1, wherein said hearing aid means comprises:

a liquid-tight and gas-tight housing adapted for implantation in the head of said user in the region of an ear and adapted to be secured to a skull bone of said user;

an amplifier in said housing;

a first microphone adapted for implantation in the auditory canal of said user and being sensitive to said sound having frequencies in the normal human audible sound range, said microphone having an implanted electrical connection to said amplifier in said housing;

a piezoelectric vibrator adapted to be secured to and implanted in the middle ear of said user in place of the malleus and having an implanted electrical connection to said amplifier in said housing, said piezoelectric vibrator having a free end adapted to vibrate the stapes of said user corresponding to electrical signals supplied by said amplifier;

a second microphone sensitive to said frequency outside of the normal human audible sound range functioning as said receiver means for converting said acoustic control signal into said electrical control signal; and frequency selective means in said housing connected to said first microphone and to said second microphone, and to said amplifier and to said adjustable component for separating said signals from said first and second microphones.

7. A hearing aid system as claimed in claim 6, wherein said housing is secured to said skull bone by a fastening element, and wherein said second microphone is disposed in said housing and is mechanically connected to said fastening element.

8. A hearing aid system as claimed in claim 6, wherein said second microphone is disposed remote from said housing in the region of said piezoelectric vibrator, and further comprising an implanted electrical line connecting second microphone to said frequency selective means.

9. A hearing aid system as claimed in claim 8, further comprising mechanical connection means for coupling said second microphone to the fastening location of said piezoelectric vibrator.

10. A hearing aid system as claimed in claim 1, wherein said wireless control means is contained in a flat housing adapted to fit in the palm of the hand of said user.

11. A hearing aid system as claimed in claim 10, wherein said flat housing has an anti-slip coating on a surface thereof in contact with the palm of the hand.

12. A hearing aid system as claimed in claim 1, wherein said wireless control means includes means for deenergizing said wireless control means when there is no acoustic transmission via the body of said user.

13. A hearing aid system as claimed in claim 1, wherein said wireless control means includes means for generating a serial sequence of data and check bits for encoding said information-containing signal and means for modulating a carrier signal at said frequency outside of said normal human audible sound range with said information-containing signal to form said acoustic control signal, and wherein said receiver means includes means for decoding said acoustic control signal to regain said information-containing signal.

14. A hearing aid system as claimed in claim 13, wherein said wireless control means further comprises:

a clock generator;

means for repeating said serial sequence of data and check bits a frequency defined by said clock generator; and means controlled by said clock generator for transmitting said acoustic control signal for a selected time and thereafter switching said wireless control means to a standby state for receiving further information from said user.

15. A method for assisting a hearing-impaired person in recognizing sound having frequencies in the normal human audible sound range comprising the steps of:

disposing means sensitive to said sound having frequencies in the normal human audible sound range in the region of an ear of said person for assisting in the transmission of said sound to the middle ear of said person, said means for assisting including at least one adjustable component;

generating in a unit held in the hand of said person an acoustic control signal for adjusting said adjustable component by operating a vibrator at a frequency outside of said normal human audible sound range;

placing the hand of said user including said unit against the skin of said person covering a bone being located near the body surface to acoustically transmit said acoustic control signal through the body of said person;

disposing a means for receiving said control signal in the region of said ear; and supplying said control signal from said means for receiving to said adjustable component.

* * * * *